US007669379B2

(12) United States Patent
Schierding

(10) Patent No.: US 7,669,379 B2
(45) Date of Patent: Mar. 2, 2010

(54) METAL TRUSS SYSTEM

(76) Inventor: Gerald Bruce Schierding, 3300 Panel Way, St. Charles, MO (US) 63301

( * ) Notice: Subject to any disclaimer, the term of this patent is extended or adjusted under 35 U.S.C. 154(b) by 100 days.

(21) Appl. No.: 11/611,540

(22) Filed: Dec. 15, 2006

(65) Prior Publication Data

US 2008/0141612 A1 Jun. 19, 2008

(51) Int. Cl.
*E04B 7/04* (2006.01)

(52) U.S. Cl. ..... 52/634; 52/636; 52/643; 52/693

(58) Field of Classification Search ..... 52/636, 52/634, 635, 633, 643, 692, 693, 694, 695, 52/697, 838, 93.1
See application file for complete search history.

(56) References Cited

U.S. PATENT DOCUMENTS

| | | | | | |
|---|---|---|---|---|---|
| 1,311,820 | A | * | 7/1919 | Lachman | 52/636 |
| 1,638,634 | A | * | 8/1927 | Lachman | 52/692 |
| 1,638,637 | A | * | 8/1927 | Lachman | 52/692 |
| 1,680,976 | A | | 8/1928 | Frease | |
| 1,880,480 | A | * | 10/1932 | Ragsdale | 52/692 |
| 2,112,480 | A | * | 3/1938 | Coddington | 52/376 |
| 2,129,624 | A | * | 9/1938 | Rafter | 52/636 |
| 2,147,965 | A | * | 2/1939 | Clauss | 52/377 |
| 2,169,253 | A | | 8/1939 | Kotrbaty | |
| 2,459,037 | A | * | 1/1949 | McIntosh | 52/376 |
| 2,500,940 | A | * | 3/1950 | Fischer et al. | 52/377 |
| 2,514,607 | A | * | 7/1950 | McLean | 52/692 |
| 2,630,890 | A | * | 3/1953 | Macomber | 52/377 |
| 3,158,925 | A | * | 12/1964 | Edge | 29/897.31 |
| 3,513,612 | A | * | 5/1970 | Alziari | 52/632 |
| 3,686,819 | A | | 8/1972 | Atkinson | |
| 4,691,494 | A | | 9/1987 | Gwynne | |
| 4,878,323 | A | | 11/1989 | Nelson | |
| 4,937,997 | A | * | 7/1990 | Thomas et al. | 52/693 |
| 4,982,545 | A | * | 1/1991 | Stromback | 52/639 |
| 4,986,051 | A | | 1/1991 | Meyer | |
| 5,417,028 | A | | 5/1995 | Meyer | |
| 5,771,653 | A | * | 6/1998 | Dolati et al. | 52/846 |
| 5,865,008 | A | | 2/1999 | Larson | |
| 5,927,041 | A | | 7/1999 | Sedlmeier | |
| 6,073,414 | A | | 6/2000 | Garris | |
| 6,079,174 | A | * | 6/2000 | Williams et al. | 52/243.1 |
| 6,088,988 | A | | 7/2000 | Sahramaa | |
| 6,170,217 | B1 | * | 1/2001 | Meyer | 52/693 |
| 6,360,509 | B1 | | 3/2002 | Sluiter | |
| 6,519,908 | B1 | * | 2/2003 | Masterson et al. | 52/696 |
| 6,553,736 | B2 | | 4/2003 | Montanaro | |
| 6,634,153 | B1 | * | 10/2003 | Peterson | 52/695 |
| 6,658,809 | B2 | | 12/2003 | Collins | |
| 6,799,406 | B2 | * | 10/2004 | Gosselin et al. | 52/694 |
| 6,874,294 | B2 | | 4/2005 | Masterson | |
| 7,093,401 | B2 | | 8/2006 | Collins | |
| 7,240,463 | B2 | * | 7/2007 | Masterson et al. | 52/693 |

* cited by examiner

*Primary Examiner*—Phi Dieu Tran A

(57) ABSTRACT

A metal truss system comprising a pair of chord members of generally U-shaped cross-sectional configuration is joined together by a web formed of a single continuous piece having a wave shape. The apexes of the web are adapted to be received in each chord. The legs of the chords have inwardly recessed portions to form a narrowed throat portion, which provides a stop against which the apex of the web abuts. The resulting positioning of the web apex presents a maximum surface area for welding the web to the chord member. This enables an optimum amount of welding, while minimizing the weakening of the metal being welded. The configuration of the chords and web permits rapid fabrication of the truss.

21 Claims, 5 Drawing Sheets

METAL TRUSS SYSTEM

BACKGROUND OF THE INVENTION

The invention relates to materials used in the construction of buildings, and in particular to trusses and joists for supporting roofs, floors, ceilings, walls and decks. More particularly, the invention relates to trusses and joists fabricated from metal.

There exist numerous truss and joist systems that provide enhanced strength attributes, assembly simplification features, and economies in material and structural composition. The savings in time, effort and money are critical in the construction industry; therefore there is a significant need and demand for truss and joist systems having these traits. While there exist a wide variety of configurations, one common form of truss/joist comprises a pair of elongated chord members joined together by a plurality of web members that span between the chord members. The chord members of this arrangement each comprise a generally U-shaped, integral piece of metal which receive the ends of the web members in the U-shaped portion. The web members are typically secured to the chord members by mechanical means such as screws and rivets, or by welding. Trusses and joists are most economically prefabricated and shipped to construction sites, rather than built as needed at the construction site. While this presents a significant efficiency and cost-saving in construction, it is still imperative that costs of materials be kept as low as possible to be competitive in the industry. The assembly of component parts presents a labor factor that affects the overall cost of the truss/joist. It can take a significant amount of time for the web members to be inserted into, aligned with, and attached to the chord members in manufacturing the truss/joist. Therefore, the manner of assembly of the truss/joist offers an area which can addressed as a way to further lower the cost of materials used in construction.

Accordingly, it is desirable to provide a low cost metal truss/joist having features which enable rapid assembly, while offering enhanced strength and load capacities

BRIEF SUMMARY OF THE INVENTION

There is, therefore, provided in the practice of the invention a metal truss and joist system comprised of a pair of chord members joined together by web members. As used herein, the term "truss" shall commonly refer to both trusses and joists as their respective structures are essentially the same for purposes of the invention.

In accordance with an embodiment of the present invention, the truss system comprises upper and lower chords joined together by a web. Each chord is generally U-shaped in cross-sectional configuration, and forms a base with legs extending at essentially right angles from either side of the base. The web is generally formed of a single, continuous piece and is formed with waves whose apexes are adapted to be received in each chord. The legs of the chords have inwardly recessed portions at an intermediate position along their lengths, giving the chord a narrowed throat portion at that position. The throat portion provides a stop against which the apex of the web abuts. The depth of the space from the opening in the chord up to the narrowed throat portion allows positioning of the apex of the web so that a maximum surface area of the web is presented for welding to the outer edge of the chord. By increasing the maximum surface area available for attachment of the web to the chord, an optimum amount of welding can be effected, while minimizing the weakening of the metal being welded.

In accordance with another embodiment of the invention, the truss system comprises a configuration of chords and web which permits rapid alignment in assembly of the truss.

In accordance with another embodiment of the present invention, each leg of the chord has its end terminating in outward, reversely extending crimped portion. This feature, combined with the recessed portion, provides enhanced strength to the chord.

Accordingly, it is an object of the present invention to provide an improved truss system. There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
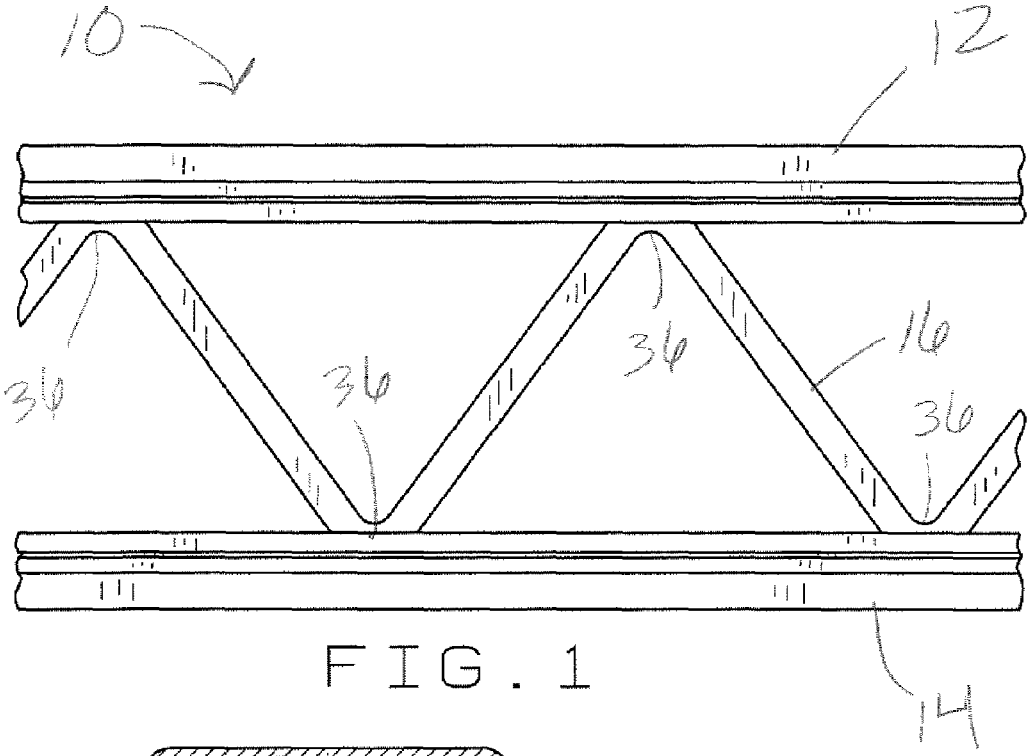
FIG. 1 is a side elevation view illustrating a truss according to a preferred embodiment of the invention.
Figure 2:
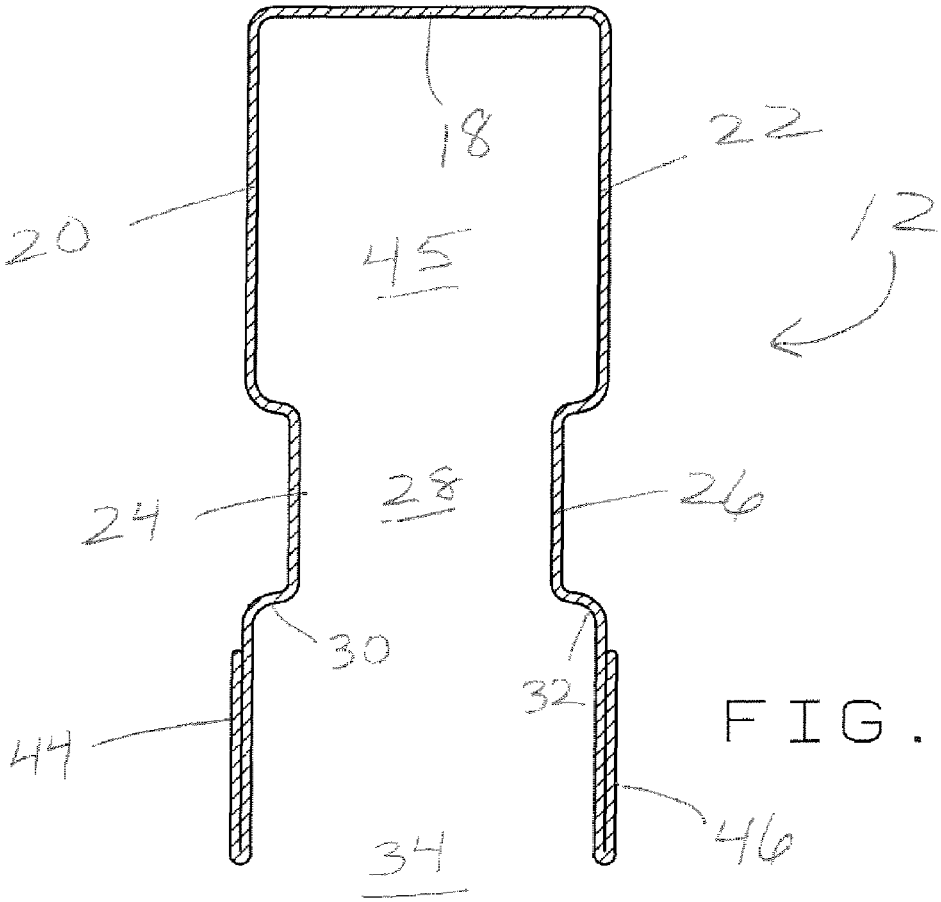
FIG. 2 is a cross-sectional view in side elevation of a chord according to a preferred embodiment of the invention.
Figure 3:
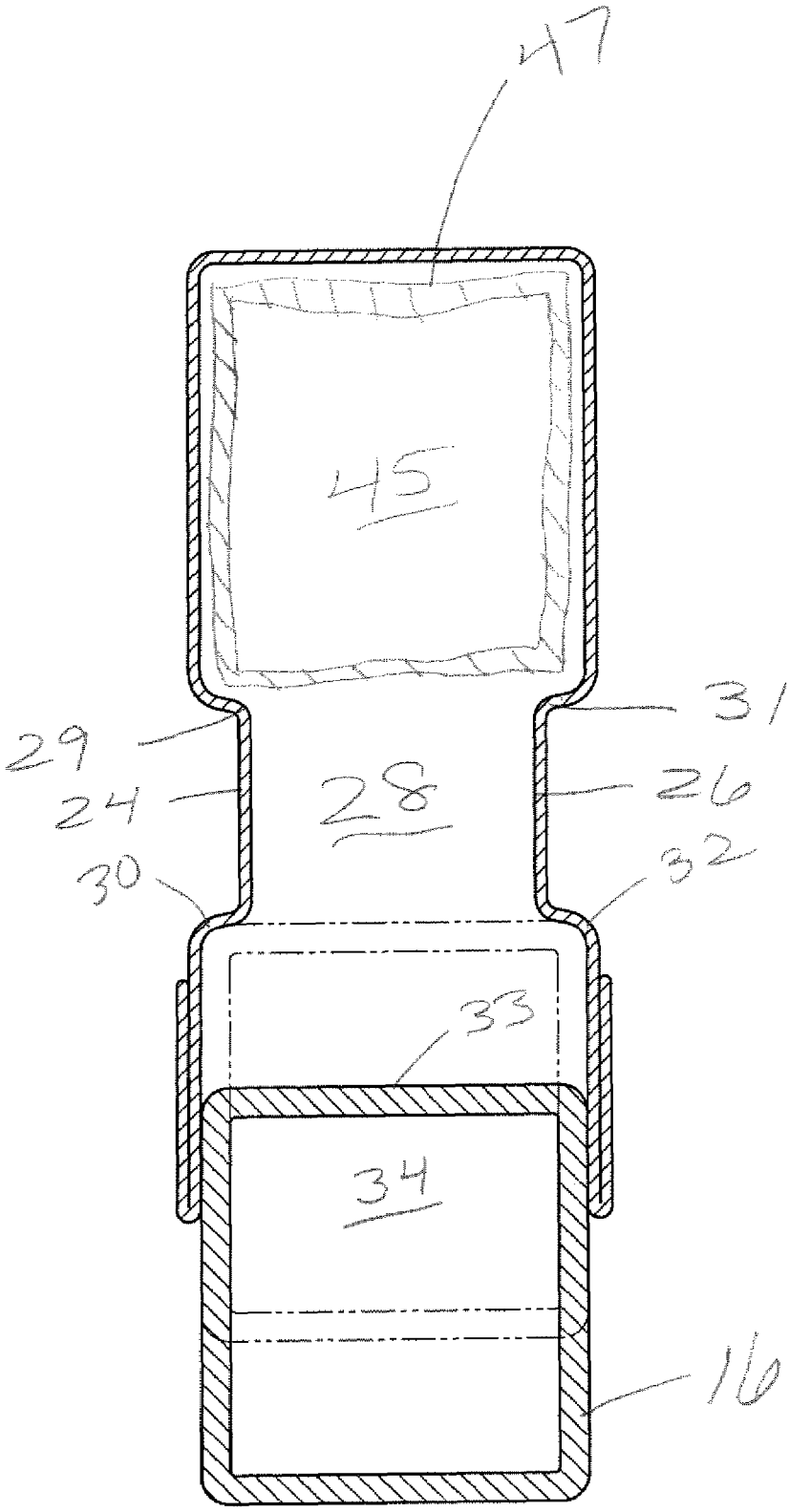
FIG. 3 is a cross-sectional view similar to FIG. 2, showing the web in cross-section and in phantom.

An embodiment of the present inventive truss system 10 is illustrated in FIG. 1. It is comprised of upper chord 12, lower chord 14 and web member 16. The configuration of upper chord 12 and lower chord 14 are similar, except for being oriented opposite of each other. Therefore, for efficiency in explanation, the description of chord 12 herein will be equally applicable to chord 14. As shown in FIG. 2, chord 12 has a generally U-shaped cross-sectional configuration, and is comprised of a base portion 18 and leg members 20 and 22. Leg members 20 and 22 extend at substantially right angles from base portion 18. Chord 12 is optimally formed from a single piece of metal, preferably around 14-18 gauge, which can be bent into the prescribed shape. Each of leg members 20 and 22 is formed with an inward recessed portion 24 and 26, respectively, at an intermediate position thereof, which extends along the entire longitudinal span of the chord. Recessed portions 24 and 26 oppose and approach each other within the chord to form a narrowed throat portion 28. The lower ends of recessed portions 24 and 26 form shoulders 30 and 32, respectively, which provide a partial boundary between chord opening 34 and interior chamber 45 of chord 12. Preferably, shoulders 30 and 32 have a substantially orthogonal shape. As shown in FIG. 3, interior chamber 45 also provides a compartment for receiving a reinforcing element 47, such as a steel tube or bar, for strengthening the chord. The reinforcing element 47 is held within interior chamber 45 by upper shoulders 29 and 31 of inward recessed portions 24 and 26, respectively, as shown in FIG. 3. Reinforcing element 47 is an elongated piece that can be inserted into an open end of the chord member and pushed down along the interior of the chord member a desired distance. The length of reinforcing element 47 can be coterminous with the chord member, or a shorter length, depending on the strength requirements necessary. Reinforcing element 47 may be held in place within interior chamber 45 through plug welds.

Figure 4:
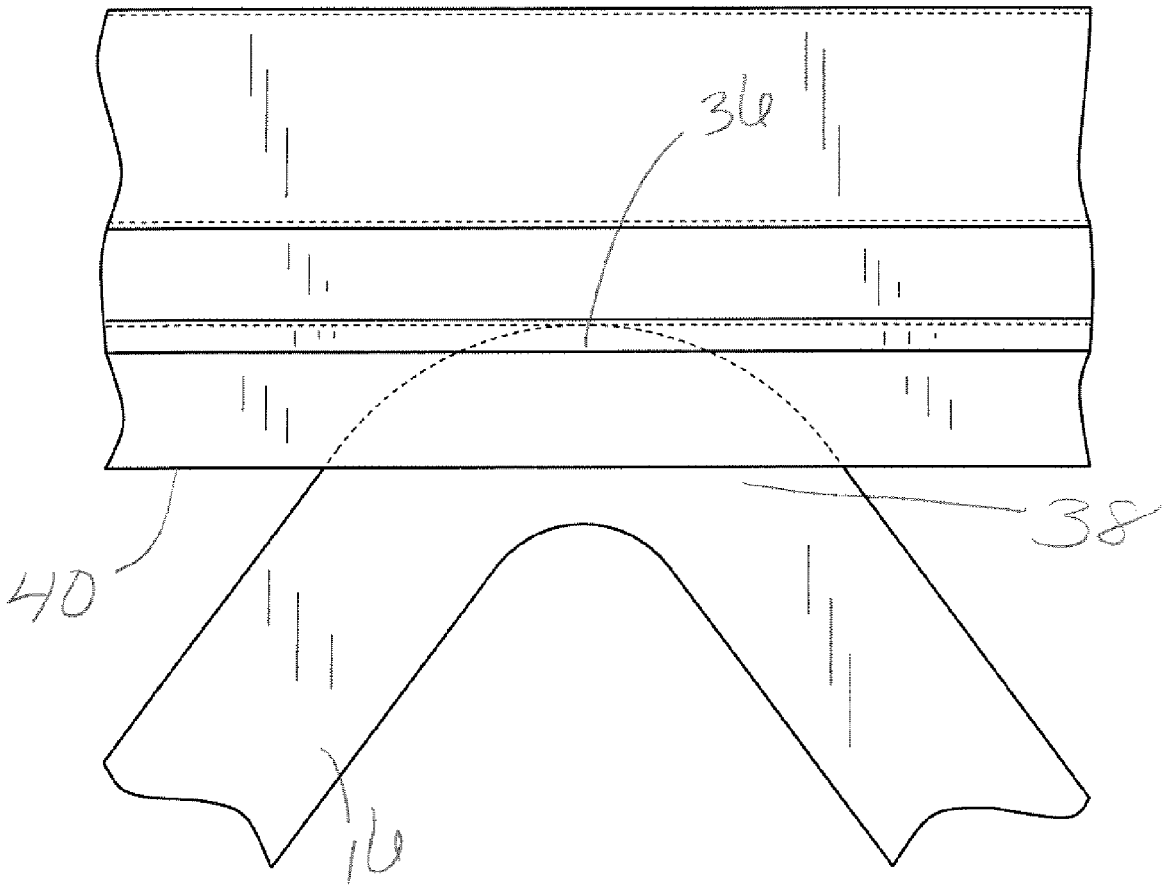
FIG. 4 is a partial view of the truss system, showing the insertion of the apex of a web inserted into a chord.
Figure 5:
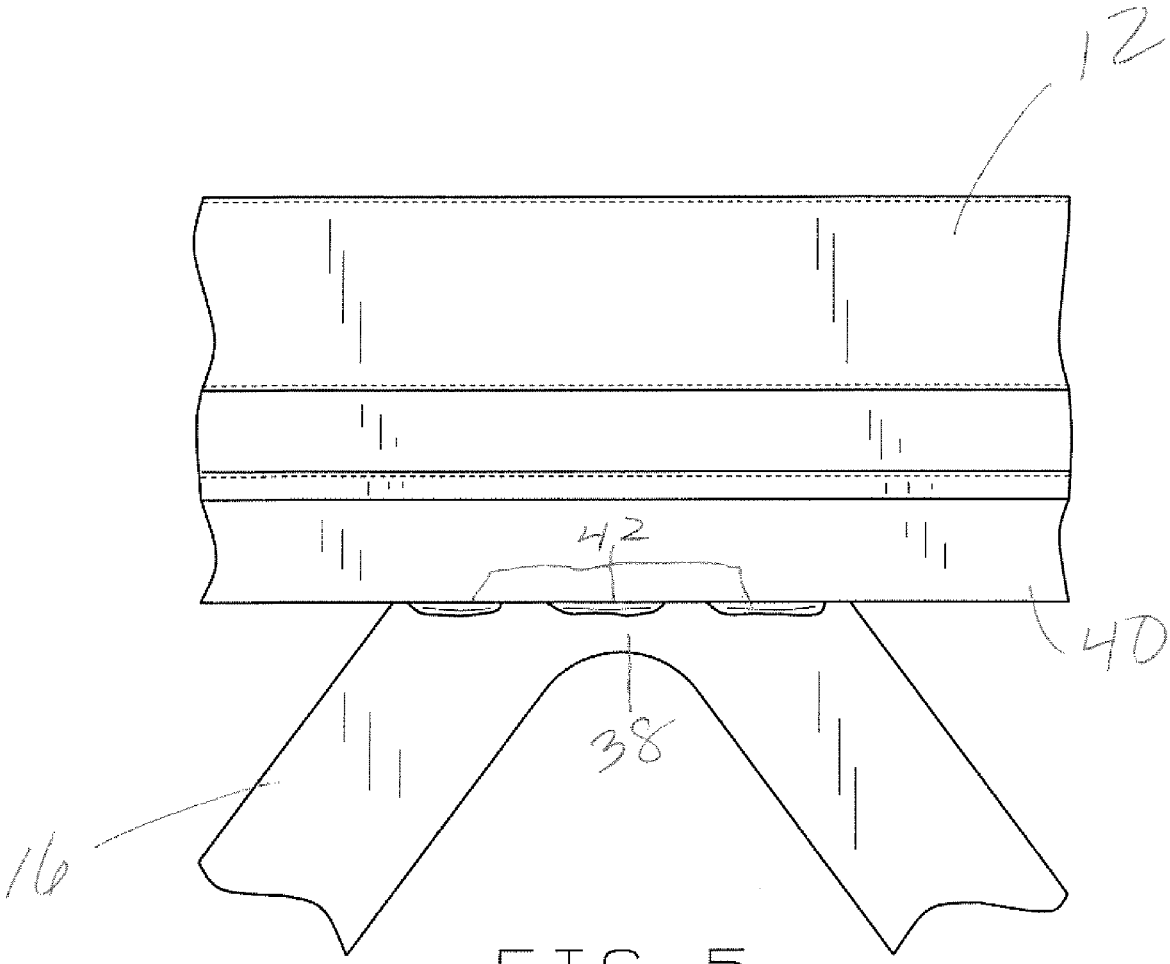
FIG. 5 is a view similar to FIG. 4, showing the web as being welded to the chord.

Web member 16 is formed of a single piece and is bent into repeating wave sections, and is adapted to span back and forth between chord members 12 and 14 as shown in FIG. 1. Web member 16 is optimally formed of metal tubing, which can be either square or rectangular. The cross-width 33 of web member 16 closely approximates the dimension of chord opening 34 as shown in FIG. 3. Shoulders 30 and 32 act as stops against the square corners of web member 16 to limit the depth to which web member 16 is inserted into the chord as shown in FIG. 4, and provide a guide for assembling the truss system. The back-and-forth bending of web member 16 creates a series of apexes 36 which are introduced into chords 12 and 14 as shown in FIG. 1. The area provided by chord opening 34, as limited by narrowed throat portion 28, permits sufficient introduction of apex 36 so that its meniscus 38 lies substantially along the ends 40 of leg members 20 and 22 as shown in FIG. 4. This maximizes the available area of web member 16 against which to weld for securing to the chord as shown in FIG. 5. While single-piece (non-continuous) web members placed at an angle would present a greater surface area for welding than a single piece placed at right-angles to the chord, it is nevertheless undesirable to utilize that entire surface because excessive welding, and the heat it generates, can create distortions in the components. Such distortions will actually weaken the web member substrate which can result in truss failure while under a load. Accordingly, the larger surface area provided by placing the meniscus 38 along the ends 40 of the leg members 20 and 22 permits multiple, discrete welding points 42 without having to weld across the entire point of contact as shown in FIG. 5. The use of short welds reduces the intensity of the heat, thereby lessening the potential for distortions in the component material. Thus, a stronger connection is made between web member 16 and chord 12, while minimizing substrate degradation from welding.

Figure 6:
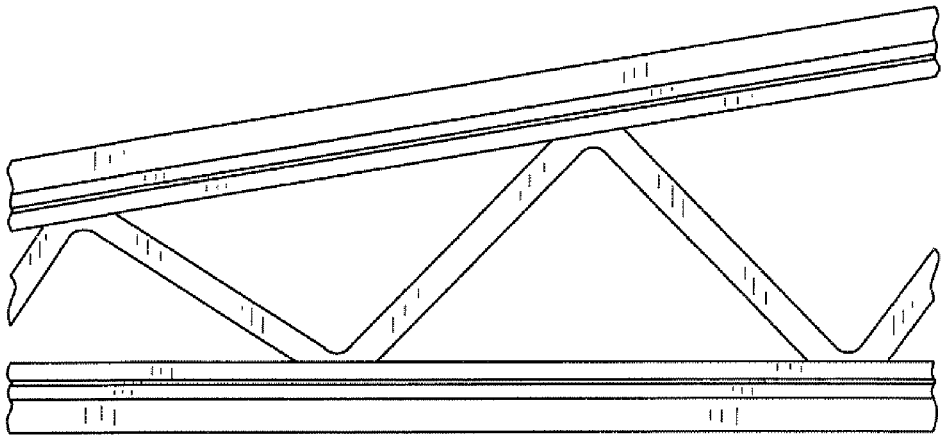
FIG. 6 is a side elevation view illustrating a truss according to another embodiment of the invention.

The configuration of the chords and web member permits the fabrication of trusses to occur more quickly. The channel provided by the narrowed throat portion 28 of chord 12, and the stop point provided by shoulders 30 and 32, enable quick insertion and placement of web member 16 into the chord. The continuous, single-piece wave form web member 16 is relatively self-aligning due to the narrowed throat portion against which it engages. Web member 16 is simply pushed up into the chord until it engages against shoulders 30 and 32, as shown in FIG. 3, which automatically positions the meniscus 38 along ends 40 of leg members 20 and 22 where welding is made. The wave angle of the web member is fixed, so it is unnecessary to adjust the angle of insertion of the web member within the chord. Further, welding of the web member to the chords can be done in one consolidated process, rather than serially where each individual member would have to be first positioned and aligned and then welded. As such, the assemblage of the truss can be carried out by an automated assembly line process. Thus, a tremendous time-savings in truss construction is made possible. Measurements for the proposed truss can be made in advance of the assembly, so that the proper dimensions of the web member can be prepared. The invention is equally applicable in the construction of triangular trusses, whose upper and lower chord members lie transversely to each other as shown in FIG. 6, and is not limited to trusses whose chords are aligned parallel.

A preferred embodiment of the chord's structure comprises a width at the base portion 18 being 1.716 inches, a height of 4.00 inches, and a width of 1.50 inches at throat opening 34. Each recessed portion 24 and 26 is 0.75 inches in height, and are positioned opposite each other in the chord at a distance of 1.00 inches. Each of ends 44 and 46 of leg members 20 and 22 are bent back outwardly to lie back against the chord as shown in FIG. 2. This provides an additional thickness at the leg ends of the chord to provide stiffening and strength thereto. Each of ends 44 and 46 are 1.00 inches long. Each of shoulders 30 and 32 extend into throat opening 34 a distance of 0.25 inches.

Figures 7, 8:
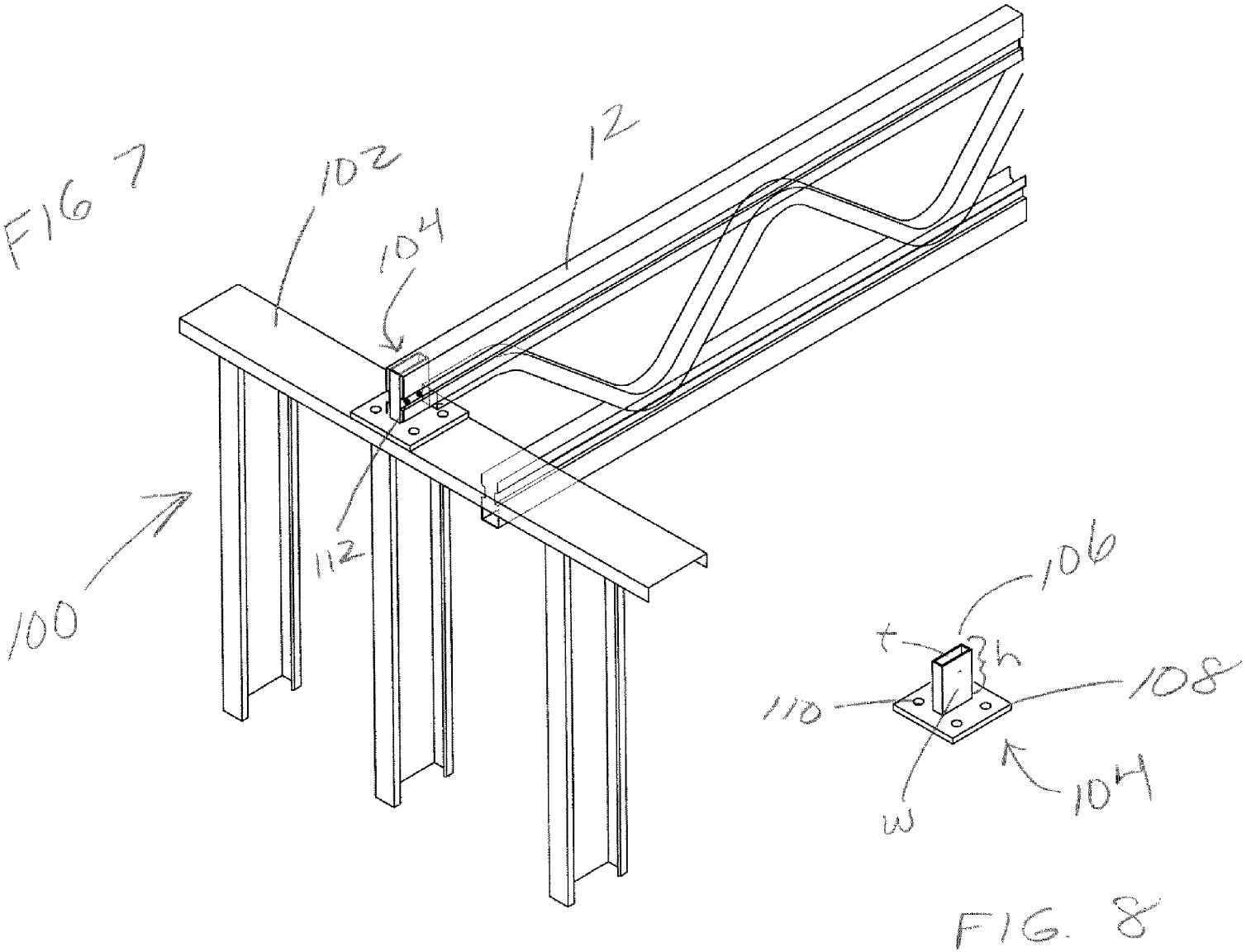
FIG. 7 is a perspective view of another embodiment of the truss system.
FIG. 8 is a perspective view of the truss system support member.

Another embodiment of the inventive truss system comprises a support member for receiving and supporting a terminal end of the top chord when erected. A truss is typically supported on a wall stud support 100 by being secured to a top beam 102 of the wall stud support as shown in FIG. 7. By means of the present embodiment of the invention, a support member 104 is adapted for securing to the top of beam 102 of the wall stud support 100 and which is received within the inner chamber of the top chord 12 for supporting the truss on top of the wall stud support 100.

Support member 104 is further shown in FIG. 8 and comprises a rectangular shaped member 106 whose height h approximates the internal depth of top chord 12 and whose thickness t approximates the width of narrowed throat portion 28 of top chord 12. The width w of support member 104 may be around a few inches. Rectangular shaped member 106 is vertically supported on base plate 108 by welding or the like. Alternatively, member 106 and base plate 108 may be integrally formed as one piece. A series of bolt holes 110 may be provided in base plate 108 by which support member 104 may be bolted to top beam 102 of the wall stud support. Alternatively, base plate 108 may be welded to top beam 102.

Support member 104 provides a simple connection point for placing a terminal end of chord 12 for support on wall stud support 100 as shown in FIG. 7. The respective dimensions of support member 104 and chord 12 are such that chord 12 is simply placed over and onto support member 104. The recessed wall portions 24 and 26 of chord 12 closely engage support member 104 and fasteners 112 (such as screws) can be used to secure chord 12 to the support member 104 at the areas where wall portions 24 and 26 engage chord 12. Support member 104 helps to stabilize and hold the truss in its vertical orientation. A support member 104 would be provided for each terminal end of an individual truss.

Another advantage provided by support member 104 is that it makes erection of the structure using the truss system simpler by providing an alignment guide. By placing the support members at the appropriate spaced apart distances on the top beam 102 of the wall stud support, workers can more quickly and accurately connect the trusses to the wall stud support. A further advantage is that the overall height of the erected structure may be reduced because the connecting the top chord, instead of the bottom chord, to the top beam of the wall stud support lowers the effective height of the erected truss by a few feet.

From the above description of preferred embodiments of the invention, those skilled in the art will perceive improvements, changes and modifications. Such improvements, changes and modifications within the skill of the art are intended to be covered by the appended claims.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

The invention claimed is:

1. A truss system comprising:

upper and lower chord members, and at least one web member;

the chord members each comprising an elongated metal section being generally U-shaped in cross-sectional configuration, each chord member further comprising a base portion and leg portions, the base portion and leg portions comprising a single integrated and continuous piece, each leg portion defining an inwardly extending recess at an intermediate position along its length, the inwardly extending recesses of the leg portions being disposed at identical locations on the respective leg portions with the leg portions lying parallel to each other along a substantially entire length of the inwardly extending recesses to define a narrowed throat portion within the chord member, the web member comprising metal tubing having a cross-sectional dimension less than a distance between an end position of the leg portions but greater than a width of the throat portion in the chord member, whereby the web member is received in an opening in the chord members to a depth limited by the throat portion such that a gap remains in the chord member between the base portion and an interface of the web member with the narrowed throat portion, each leg portion being parallel to the other leg portion along their entire length at the opening of the chord member.

2. The truss system of claim 1 in which the inwardly extending recess defined in each leg portion comprises substantially rectangular edges, the edges defining a shoulder against which the web member abuts.

3. The truss system of claim 1 in which the web member is formed of a continuous length, the web member being bent into waves such that apexes of the waves are adapted to be received in the chord members.

4. The truss system of claim 3 in which the throat portion within each chord member limits insertion of the web member such that the apex of the web member is adapted to abut against the throat portion within the chord member.

5. The truss system of claim 4 in which a depth of the chord member between the throat portion and a distal end of the leg portions approximates a cross-width dimension of the web member.

6. The truss system of claim 5 in which a meniscus of the web member lies at the end position of the leg portions of the chord whereby the leg portions at their distal end engage the web member.

7. The truss system of claim 6 in which the upper and lower chord members lie parallel to each other.

8. The truss system of claim 6 in which the upper chord member is positioned in a transverse relationship to the lower chord member.

9. A truss system comprising:

upper and lower chord members, and at least one web member;

the chord members each comprising an elongated metal section being generally U-shaped in cross-sectional configuration, each chord member further comprising a base portion and leg portions, the base portion and leg portions comprising a single integrated and continuous piece, each leg portion defining an end wherein a terminal portion of the leg portion is bent back outwardly and reversely to lie against itself, each leg portion defining an inwardly extending recess at an intermediate position along its length, the inwardly extending recesses of the leg portions being disposed at identical locations on the respective leg portions with the leg portions lying parallel to each other along a substantially entire length of the inwardly extending recesses to define a narrowed throat portion within the chord member, the web member comprising metal tubing having a cross-sectional dimension less than a distance between an end position of the leg portions but greater than a width of the throat portion in the chord member, whereby the web member is received in an opening in the chord members to a depth limited by the throat portion such that a gap remains in the chord member between the base portion and an interface of the web member with the narrowed throat portion, each leg portion being parallel to the other leg portion along their entire length at the opening of the chord member.

10. The truss system of claim 9 in which the inwardly extending recess defined in each leg portion comprises substantially rectangular edges, the edges defining a shoulder against which the web member abuts.

11. The truss system of claim 9 in which the web member is formed of a continuous length, the web member being bent into waves such that apexes of the waves are adapted to be received in the chord members.

12. The truss system of claim 11 in which the throat portion within each chord member limits insertion of the web member such that the apex of the web member is adapted to abut against the throat portion within the chord member.

13. The truss system of claim 12 in which a depth of the chord member between the throat portion and a distal end of the leg portions approximates a cross-width dimension of the web member.

14. The truss system of claim 13 in which a meniscus of the web member lies at the end position of the leg portions of the chord whereby the leg portions at their distal end engage the web member.

15. The truss system of claim 14 in which the upper and lower chord members lie parallel to each other.

16. The truss system of claim 14 in which the upper chord member is positioned in a transverse relationship to the lower chord member.

17. A truss system comprising:

upper and lower chord members, at least one reinforcing member, and at least one web member;

the chord members each comprising an elongated metal section being generally U-shaped in cross-sectional configuration, each chord member further comprising a base portion and leg portions, the base portion and leg portions comprising a single integrated and continuous piece, each leg portion defining an inwardly extending recess at an intermediate position along its length, the inwardly extending recesses of the leg portions being disposed at identical locations on the respective leg portions with the leg portions lying parallel to each other along a substantially entire length of the inwardly extending recesses to define a narrowed throat portion within the chord member, the web member comprising metal tubing having a cross-sectional dimension less than a distance between an end position of the leg portions but greater than a width of the throat portion in the chord member, whereby the web member is received in an opening in the chord members to a depth limited by the throat portion such that a gap remains in the chord member between the base portion and an interface of the web member with the narrowed throat portion, each leg portion being parallel to the other leg portion along their entire length at the opening of the chord member, the at least one reinforcing member being adapted for insertion into the gap in at least one chord member, the at least one reinforcing member being adapted to be held in position and bounded by the base portion, the leg portions and the throat portion.

18. The truss system of claim 17 in which the at least one reinforcing member is held in position by being plug welded to the chord member.

19. The truss system of claim 17 in which each leg portion defines an end wherein a terminal portion of the leg portion is bent back outwardly and reversely to lie against itself.

20. A truss system comprising:

upper and lower chord members, at least one web member; and at least one truss terminal end support member;

the chord members each comprising an elongated metal section being generally U-shaped in cross-sectional configuration, each chord member further comprising a base portion and leg portions, the base portion and leg portions comprising a single integrated and continuous piece, each leg portion defining an inwardly extending recess at an intermediate position along its length, the inwardly extending recesses of the leg portions being disposed at identical locations on the respective leg portions with the leg portions lying parallel to each other along a substantially entire length of the inwardly extending recesses to define a narrowed throat portion within the chord member, the web member comprising metal tubing having a cross-sectional dimension less than a distance between an end position of the leg portions but greater than a width of the throat portion in the chord member, whereby the web member is received in an opening in the chord members to a depth limited by the throat portion such that a gap remains in the chord member between the base portion and an interface of the web member with the narrowed throat portion, each leg portion being parallel to the other leg portion along their entire length at the opening of the chord member, the truss terminal end support member being [adapted to be] secured to a surface where a terminal end of the truss system is to be anchored, the truss terminal end support member having a height approximating a depth of the chord member and a thickness approximating the width of the throat portion in the chord member, the truss terminal end support member being adapted to be received in the throat portion of the upper chord member to provide support to the terminal end of the truss system in an orientation where the upper chord member is supported and the lower chord member depends below the upper chord.

21. The truss system of claim 20 in which each leg portion defines an end wherein a terminal portion of the leg portion is bent back outwardly and reversely to lie against itself.

* * * * *